US005642188A

United States Patent [19]

Mochizuki et al.

[11] Patent Number: 5,642,188

[45] Date of Patent: Jun. 24, 1997

[54] WET-TYPE ELECTROPHOTOGRAPHIC IMAGE FORMATION METHOD

[75] Inventors: Manabu Mochizuki, Yokohama; Tsuneo Kurotori, Tokyo; Kenzo Ariyama, Yokohama; Kenji Kojima; Ichiro Tsuruoka, both of Tokyo; Katsuhiro Echigo, Yokohama; Mayumi Miyao, Tokyo, all of Japan

[73] Assignee: Ricoh Company, Ltd., Tokyo, Japan

[21] Appl. No.: 281,263

[22] Filed: Jul. 27, 1994

Related U.S. Application Data

[63] Continuation of Ser. No. 8,884, Jan. 22, 1993, which is a continuation of Ser. No. 549,229, Jul. 6, 1990.

[30] Foreign Application Priority Data

Jul. 11, 1989 [JP] Japan ..... 1-177170

[51] Int. Cl.[6] ..... G03G 15/10; G03G 15/01

[52] U.S. Cl. ..... 399/237; 430/116; 399/223

[58] Field of Search ..... 355/245, 256, 355/212; 118/661, 659; 430/112, 117, 109–119

[56] References Cited

U.S. PATENT DOCUMENTS

| | | | |
|---|---|---|---|
| 3,639,246 | 2/1972 | Otsuka et al. | 43/137 |
| 4,050,804 | 9/1977 | Silverberg | 118/661 X |
| 4,056,314 | 11/1977 | Silverberg | 355/256 |
| 4,059,444 | 11/1977 | Lu et al. | 430/112 X |
| 4,062,789 | 12/1977 | Tamai et al. | 430/115 |
| 4,065,586 | 12/1977 | Eddy et al. | 430/99 |
| 4,076,405 | 2/1978 | Silverberg | 355/256 |
| 4,135,925 | 1/1979 | Wells | 430/33 |
| 4,161,453 | 7/1979 | Gilliams et al. | 430/115 |
| 4,517,272 | 5/1985 | Jadwin et al. | 130/110 |
| 4,876,169 | 10/1989 | Gruber et al. | 430/110 |
| 4,877,707 | 10/1989 | Grushkin et al. | 430/106.6 |
| 5,384,225 | 1/1995 | Kurotori et al. | 430/116 |
| 5,463,453 | 10/1995 | Kurotori et al. | 355/256 |

*Primary Examiner*—Thu A. Dang

*Attorney, Agent, or Firm*—Cooper & Dunham LLP

[57] ABSTRACT

In a wet-type electrophotographic image formation method using an organic electrophotographic photoconductor constituted of an electroconductive support and a photoconductive layer formed thereon, the steps of (1) forming a latent electrostatic image on the photoconductive layer, and (2) developing the latent electrostatic image to a visible toner image with a developer comprising toner particles and a carrier liquid constituted of or including a silicone oil in which the toner particles are dispersed.

30 Claims, 2 Drawing Sheets

WET-TYPE ELECTROPHOTOGRAPHIC IMAGE FORMATION METHOD

This is a continuation of application Ser. No. 008,884, filed Jan. 22, 1993, which is a continuation of application Ser. No. 549,229, filed Jul. 6, 1990.

BACKGROUND OF THE INVENTION

1. Field of the Invention

The present invention relates to a wet-type electrophotographic image formation method, and more particularly to a wet-type electrophotographic image formation method using a liquid developer comprising a carrier liquid comprising a silicone oil and toner particles dispersed therein, which liquid developer is particularly suitable for use with an organic photoconductor.

2. Discussion of Background

Generally in a wet-type electrophotographic image formation method, a latent electrostatic image formed on an electrophotographic photoconductor is developed to a visible toner image with a liquid developer comprising a carrier liquid and electrically charged toner particles dispersed therein. More specifically, in the wet-type electrophotographic image formation method, the latent electrostatic image is brought into contact with the liquid developer, and the electrically charged toner particles dispersed in the carrier liquid are deposited on the latent electrostatic image, so that the latent electrostatic image is developed to a visible toner image. The thus formed toner image on the photoconductor is transferred to a sheet of paper and then fixed on the paper with application of heat thereto.

Since the liquid developer employed in the above wet-type electrophotographic image formation method comprises finely-divided toner particles, generally having a particle diameter of 1 μm or less, the wet-type electrophotographic image formation method has the advantage that the reproduction of fine line images, gradation and color images is excellent.

Furthermore, in the wet-type electrophotographic image formation method, toner particles are never scattered in the air, as occurs with a dry-type electrophotographic image formation method using a dry-type toner. Moreover, since the toner particles can be uniformly dispersed in the carrier liquid, they can be uniformly deposited on the latent electrostatic images formed on the photoconductor. This method is therefore adaptable to a high speed image formation process.

In comparison with organic photoconductors, however, the above inorganic photoconductors have the drawbacks that the cost is higher and they cannot easily be worked into a belt-type photoconductor because of their poorer flexibility. This will limit the incorporation or layout of the photoconductor in the copying apparatus. In addition to the above, the inorganic photoconductors show no photosensitivity in a long wave-length light region, so that a semiconductor laser beam cannot be used as a light source for forming light images. Accordingly, the manufacturing cost of a printer and a digital-type copying apparatus using the inorganic photoconductors is high and it is difficult to fabricate an apparatus which is compact in size.

The conventionally employed carrier liquids for the liquid developers for use in the wet-type electrophotographic image formation method are isoparaffin-based solvents, such as, for example, those commercially available under the trademark of "Isopar", made by Exxon Chemical Japan Ltd.

The carrier liquids of this kind can only be used with inorganic materials such as selenium, selenium-tellurium and arsenic selenium and are not suitable for use with an organic electrophotographic photoconductor which comprises an electroconductive support and an organic photoconductive layer formed thereon. This is because when the conventional isoparaffin-based carrier liquids contact the organic photoconductor for an extended period of time, a component which imparts the photosensitivity to the organic photoconductor contained in an organic photoconductive layer thereof is caused to ooze therefrom and flows into the liquid developer. Thus the photosensitivity of the organic electrophotographic photoconductor gradually deteriorates as the latent electrostatic images formed on the organic photoconductor are repeatedly developed with the liquid developer over a long period of time. In particular, when the organic photoconductive layer is of a function-separation type, which comprises a charge generation layer comprising a charge generating material, for example, the materials as disclosed in U.S. Pat. No. 4,150,987 and U.S. Pat. No. 4,391,889, and a charge transport layer comprising a charge transporting material and a binder resin, the charge transporting material is readily caused to ooze from the charge transport layer while in contact with the liquid developer and is mixed with the liquid developer. This will cause the photosensitivity of the photoconductor to deteriorate considerably.

In the case where the organic photoconductive layer is prepared by dispersing finely-divided particles of the charge generating material in a solid solution comprising a charge transporting material and a binder resin, the photosensitivity of the photoconductive layer also deteriorates while in contact with the liquid developer comprising an isoparaffin solvent.

SUMMARY OF THE INVENTION

Accordingly, an object of the present invention is to provide a wet-type electrophotographic image formation method in which an organic electrophotographic photoconductor that has wide application and merit in decreasing the manufacturing cost and controlling the size of the apparatus can be used, with the advantageous characteristics of the wet-type image formation method maintained.

The above-mentioned object of the present invention can be achieved by a wet-type electrophotographic image formation method using a liquid developer comprising a carrier liquid comprising a silicone oil and toner particles dispersed therein and an organic electrophotographic photoconductor comprising an electroconductive support and a photoconductive layer formed thereon, which image formation method comprises the steps of (1) forming a latent electrostatic image on the photoconductive layer and (2) developing the latent electrostatic image with a developer comprising toner particles and a carrier liquid comprising a silicone oil in which the above toner particles are dispersed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In the wet-type electrophotographic image formation method according to the present invention, an organic electrophotographic photoconductor can be used. More specifically, latent electrostatic images formed on an organic photoconductive layer of the electrophotographic photoconductor can be developed to visible toner images by use of a liquid developer which comprises toner particles and a carrier liquid comprising a silicone oil in which the toner particles are dispersed.

Prior to a detailed explanation of the wet-type electrophotographic image formation method according to the present invention, the mechanism of a wet-type electrophotographic copying apparatus in which the wet-type electrophotographic image formation method is carried out will now be described with reference to FIG. 1.

Figure 1:
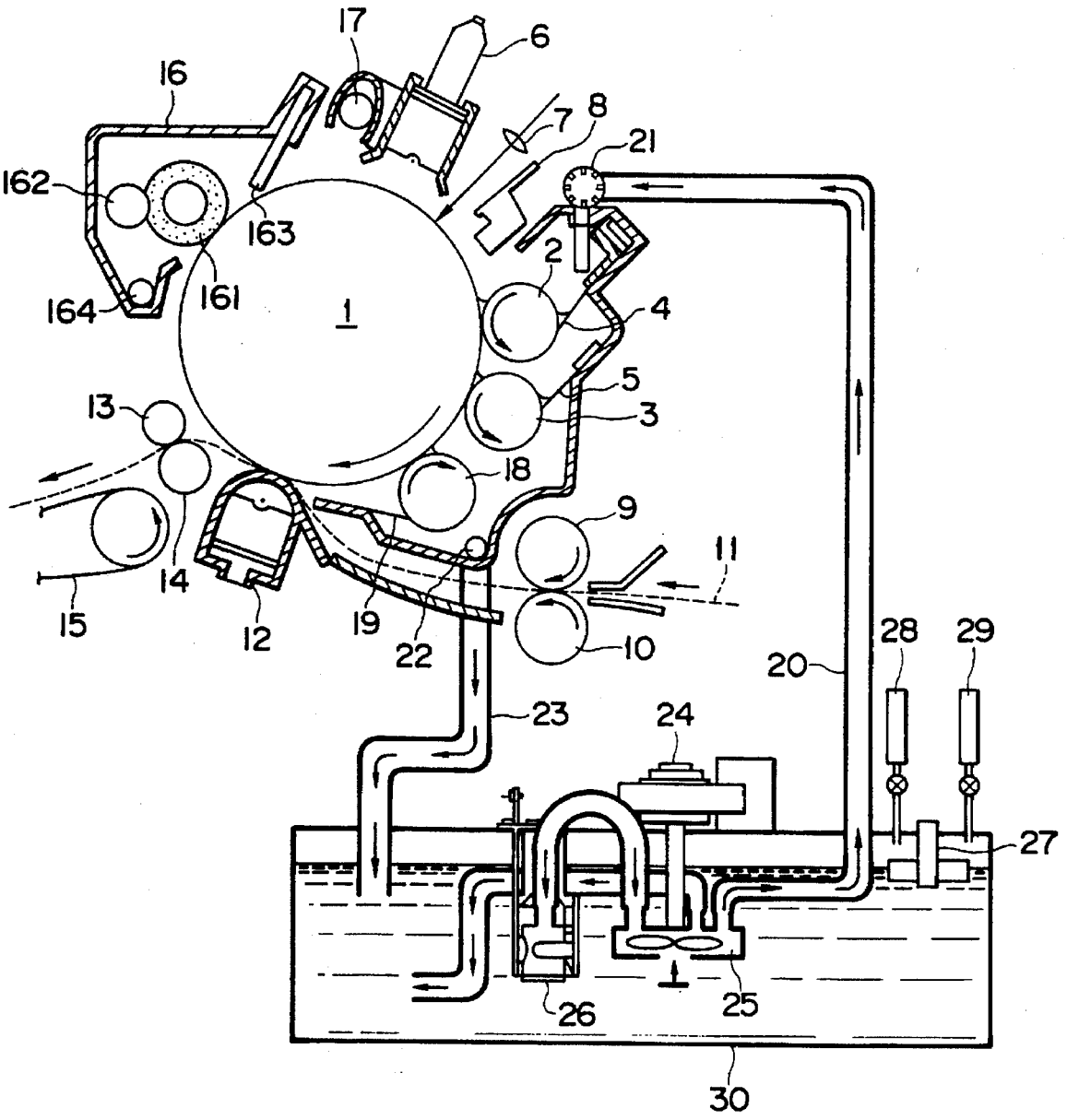
FIG. 1 is a schematic diagram of an example of a wet-type electrophotographic copying apparatus for use in the present invention.

In FIG. 1, a photoconductive drum 1 is driven in rotation in the direction of the arrow at a constant speed by a driving system (not shown) in the course of a copying operation. The outer surface of the photoconductive drum 1 is uniformly charged to a predetermined polarity by a main charger 6, and exposed to a light image which is converted from an original image by an optical system 7. Thus, a latent electrostatic image is formed on the surface of the photoconductive drum 1. The non-image-formation areas on the photoconductive drum 1 are quenched by an eraser 8.

The latent electrostatic image formed on the photoconductive drum 1 is developed to a visible toner image by means of development rollers 2 and 3 which support a liquid developer. The development rollers 2 and 3 are driven in rotation in the direction of the arrow, with a slight gap maintained between the development rollers 2 and 3 and the photoconductive drum 1. Residual toner particles are cleared off the development rollers 2 and 3 by scrapers 4 and 5.

The toner image thus developed on the photoconductive drum 1 is transferred by the aid of a transfer charger 12 to a transfer sheet 11 which is supplied from a transfer sheet supply unit (not shown) and carried by sheet-transportation rollers 9 and 10 along a paper path as indicated by the broken-line.

Figure 2:
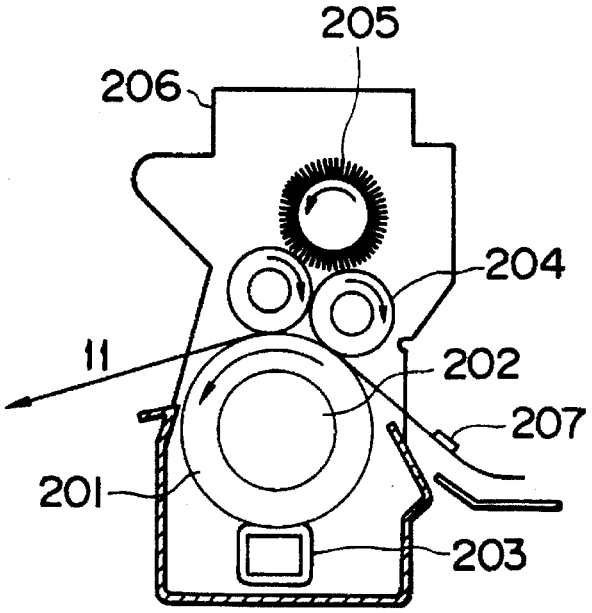
FIG. 2 is a schematic diagram of an image fixing unit in the electrophotographic copying apparatus shown in FIG. 1.

The transfer sheet 11 which bears the toner image is separated from the surface of the photoconductive drum 1 by separation rollers 13 and 14 and led to an image fixing unit as shown in FIG. 2 by a transfer-sheet conveyor belt 15.

In the image fixing unit as shown in FIG. 2, the transfer sheet 11 which bears a toner image 207 is caused to pass between a heat-application roller 201 having a built-in heater 202 and two pressure-application rollers 204.

In FIG. 2, reference numeral 203 indicates a cleaning pad; reference numeral 205, a cleaning brush; and reference numeral 206, an external cover.

After the separation of the transfer sheet 11 from the photoconductive drum 1, the residual liquid developer on the photoconductive drum 1 is cleared therefrom in a cleaning unit 16 and the residual electric charge of the photoconductive drum 1 is then quenched by a quenching lamp 17 (or a quenching charger) for the subsequent copying operation.

As shown in FIG. 1, a cleaning foam roller 161, a squeezing roller 162 and a cleaning blade 163 are disposed in the above-mentioned cleaning unit 16. The residual liquid developer collected in the cleaning unit 16 is discharged outside through a residual-developer-recovery hole 164.

In the wet-type development unit, the development rollers 2 and 3, a squeeze roller 18, and a scraper 19 in contact with the squeeze roller 18 are disposed. One or a plurality of development rollers may be mounted in the development unit. It is preferable that the development rollers 2 and 3 be disposed, with a space of 0.1 to 0.2 mm apart from the photoconductive drum 1. It is desirable that the gap between the photoconductive drum 1 and the squeeze roller 18 be in the range of 0.05 to 0.09 mm. The development rollers 2 and 3 are driven in rotation by the driving system at a higher peripheral speed than that of the photoconductive drum 1, and furthermore, the squeeze roller 18 is driven in rotation at a still higher peripheral speed in the opposite direction to that of the photoconductive drum 1 at a contact area therebetween.

The liquid developer stored in a developer tank 30 is pumped out by a pump 25 which is operated by a pump motor 24, carried through a liquid developer supply pipe 20 and supplied to the development unit via a liquid developer supply nozzle 21. The unused liquid developer in the development unit is circulated in such a fashion that the unused liquid developer flows into a liquid-developer-collection hole 22 and returns to the developer tank 30 through a liquid-developer-collection pipe 23.

In FIG. 1, reference numeral 26 indicates a liquid-developer-concentration detector; reference numeral 27, a float switch capable of detecting a liquid level; reference numeral 28, a liquid developer spare tank; and reference numeral 29, a carrier liquid spare tank.

Figure 3:
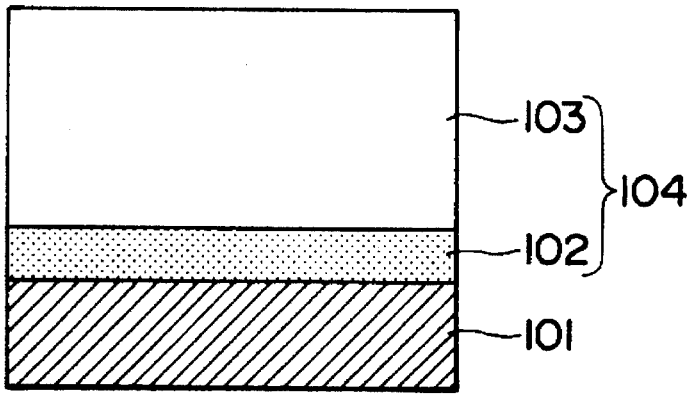
FIG. 3 PRIOR ART
FIG. 3 is a cross-sectional view of an example of an organic electrophotographic photoconductor for use in the present invention.

Any of the conventional organic electrophotographic photoconductors can be used in the present invention. In particular, as shown in FIG. 3, an organic electrophotographic photoconductor comprising an electroconductive support 101 and a photoconductive layer 104 formed thereon, which comprises a charge generation layer 102 and a charge transport layer 103, is preferably used in the present invention because that kind of organic electrophotographic photoconductor has high photosensitivity and good spectral properties in a long wavelength light region. Alternatively a conventional intermediate layer (not shown), made of, for example, polyvinyl butyral, can be interposed between the charge generation layer 102 and the charge transport layer 103.

The photoconductive layer of the organic electrophotographic photoconductor for use in the present invention may also be of a single layer type in which a charge generating material and a charge transporting material are contained, for example, in a dispersed state. Furthermore, the electrophotographic photoconductor may be in the form of an endless belt.

As the charge transporting materials, there are positive hole transporting materials and electron transporting materials.

Specific examples of the positive hole transporting materials are the compounds represented by the following general formulas (1) through (11):

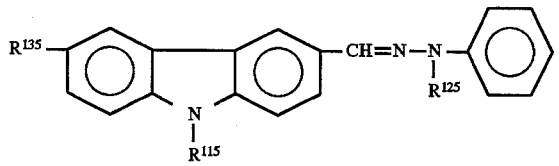

(1)

wherein $R^{115}$ represents a methyl group, an ethyl group, a 2-hydroxyethyl group, or a 2-chloroethyl group; $R^{125}$ represents a methyl group, an ethyl group, a benzyl group or a phenyl group; $R^{135}$ represents hydrogen, chlorine, bromine, an alkyl group having 1 to 4 carbon atoms, an alkoxyl group having 1 to 4 carbon atoms, a dialkylamino group or a nitro group.

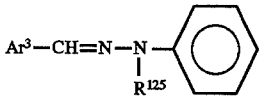

(2)

wherein $Ar^3$ represents an unsubstituted or substituted naphthalene ring, an unsubstituted or substituted anthracene ring, an unsubstituted or substituted styryl group, a pyrydine ring, a furan ring, or a thiophene ring; and $R^{145}$ represents an alkyl group or a benzyl group.

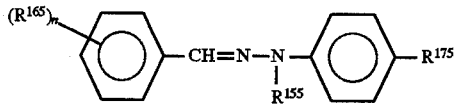

(3)

wherein $R^{155}$ represents an alkyl group, a benzyl group, a phenyl group, or a naphthyl group; $R^{165}$ represents hydrogen, an alkyl group having 1 to 3 carbon atoms, an alkoxyl group having 1 to 3 carbon atoms, a dialkylamino group, a diaralkylamino group or a diarylamino group; n is an integer of 1 to 4, and when n is 2 or more, $R^{165}$s may be the same or different; and $R^{175}$ represents hydrogen or a methoxy group.

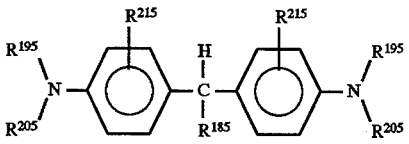

(4)

wherein $R^{185}$ represents an alkyl group having 1 to 11 carbon atoms, an unsubstituted or substituted phenyl group, or a heterocyclic ring; $R^{195}$ and $R^{205}$ may be the same or different and each represent hydrogen, an alkyl group having 1 to 4 carbon atoms, a hydroxylalkyl group, a chloroalkyl group, or an unsubstituted or substituted aralkyl group, $R^{195}$ and $R^{205}$ may be bonded to each other to form a heterocyclic ring containing nitrogen atom(s); each $R^{215}$ may be the same or different and represents hydrogen, an alkyl group having 1 to 4 carbon atoms, an alkoxyl group or halogen.

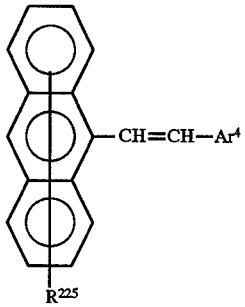

(5)

wherein $R^{225}$ represents hydrogen or halogen; and $Ar^4$ represents an unsubstituted or substituted phenyl group, an unsubstituted or substituted naphthyl group, an unsubstituted or substituted anthryl group or an unsubstituted or substituted carbazolyl group.

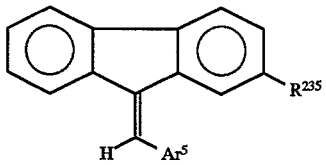

(6)

wherein $R^{235}$ represents hydrogen, halogen, a cyano group, an alkoxyl group having 1 to 4 carbon-atoms, or an alkyl group having 1 to 4 carbon atoms; $Ar^5$ represents

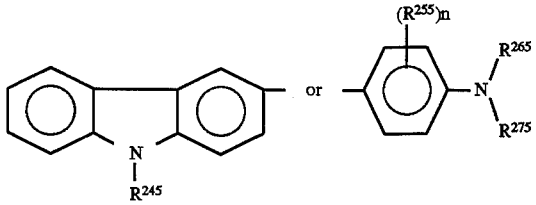

wherein $R^{245}$ represents an alkyl group having 1 to 4 carbon atoms; $R^{255}$ represents hydrogen, halogen, an alkyl group having 1 to 4 carbon atoms, an alkoxyl group having 1 to 4 carbon atoms, or a dialkylamino group; n is an integer of 1 or 2, and when n is 2, each $R^{255}$ may be the same or different; and $R^{265}$ and $R^{275}$ each represent hydrogen, an unsubstituted or substituted alkyl group having 1 to 4 carbon atoms, or an unsubstituted or substituted benzyl group.

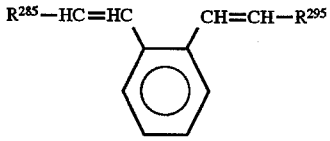

(7)

wherein $R^{285}$ and $R^{295}$ each represent a carbazolyl group, a pyridyl group, a thienyl group, an indolyl group, a furyl group, an unsubstituted or substituted phenyl group, an unsubstituted or substituted styryl group, an unsubstituted or substituted naphthyl group, an unsubstituted or substituted anthryl group, which may have a substituent selected from the group consisting of a dialkylamino group, an alkyl group, an alkoxyl group, a carboxyl group or an ester thereof, halogen, a cyano group, an aralkylamino group, an N-alkyl-N-aralkylamino group, an amino group, a nitro group and an acetylamino group.

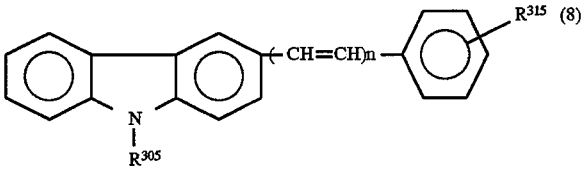

(8)

wherein $R^{305}$ represents a lower alkyl group or a benzyl group; $R^{315}$ represents hydrogen, a lower alkyl group, a lower alkoxyl group, halogen, a nitro group, an amino group which may have as a substituent a lower alkyl group or a benzyl group, and n is an integer of 1 or 2.

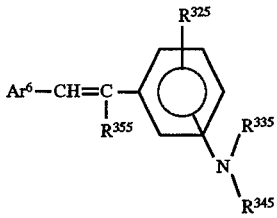

(9)

wherein $R^{325}$ represents hydrogen, an alkyl group, an alkoxyl group or halogen; $R^{335}$ and $R^{345}$ each represent an alkyl group, an unsubstituted or substituted aralkyl group, or an unsubstituted or substituted aryl group; $R^{355}$ represents hydrogen or an unsubstituted or substituted phenyl group, and $Ar^6$ represents a phenyl group or a naphthyl group.

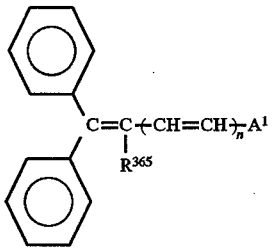

(10)

wherein n is an integer of 0 or 1; represents hydrogen, an alkyl group, or an unsubstituted or substituted phenyl group; $A^1$ represents

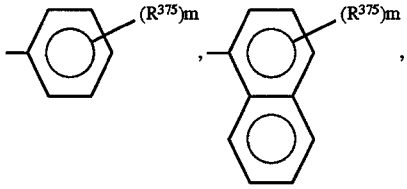

a 9-anthryl group or an unsubstituted or substituted N-alkylcarbazolyl group, wherein $R^{375}$ represents hydrogen, an alkyl group, an alkoxyl group, halogen, or

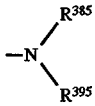

wherein $R^{385}$ and $R^{395}$ each represent an alkyl group, or an unsubstituted or substituted aryl group, and $R^{385}$ and $R^{395}$ may form a ring in combination; m is an integer of 0, 1, 2, or 3, and when m is 2 or more, each $R^{375}$ may be the same or different.

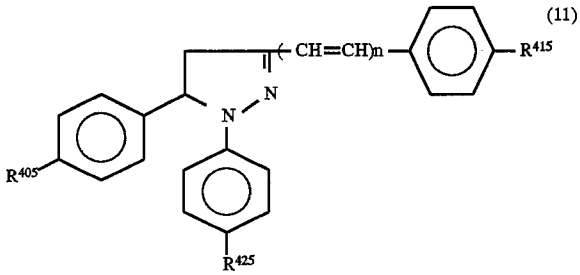

(11)

wherein $R^{405}$, $R^{415}$ and $R^{425}$ each represent hydrogen, a lower alkyl group, a lower alkoxyl group, a dialkylamino group, or halogen; and n is an integer of 0 or 1.

Specific examples of the compound represented by the above general formula (1) are 9-ethylcarbazole-3-aldehyde, 1-methyl-1-phenylhydrazone, 9-ethylcarbazole-3-aldehyde 1-benzyl-1-phenylhydrazone, and 9-ethylcarbazole-3-aldehyde 1,1-diphenylhydrazone.

Specific examples of the compound represented by the above general formula (2) are 4-diethylaminostylene-β-aldehyde 1-methyl-1-phenylhydrazone, and 4-methoxynaphthalene-1-aldehyde 1-benzyl-1-phenylhydrazone.

Specific examples of the compound represented by the above general formula (3) are 4-methoxybenzaldehyde 1-methyl-1-phenylhydrazone, 2,4-dimethoxybenzaldehyde 1-benzyl-1-phenylhydrazone, 4-diethylaminobenzaldehyde 1,1-diphenyl-hydrazone, 4-methoxybenzaldehyde 1-benzyl-1-(4-methoxy)phenylhydrazone, 4-diphenylaminobenzaldehyde 1-benzyl-1-phenylhydrazone, and 4-dibenzylaminobenzaldehyde-1,1-diphenylhydrazone.

Specific examples of the compound represented by the above general formula (4) are 1,1-bis(4-dibenzylaminophenyl)propane, tris(4-diethylaminophenyl) methane, 1,1-bis(4-dibenzylaminophenyl)propane, and 2,2'-dimethyl-4,4'-bis(diethylamino)-triphenylmethane.

Specific examples of the compound represented by the above general formula (5) are 9-(4-diethylaminostyryl) anthracene, and 9-bromo-10-(4-diethylaminostyryl) anthracene.

Specific examples of the compound represented by the above general formula (6) are 9-(4-dimethylaminobenzylidene) fluorene, and 3-(9-fluorenylidene)-9-ethylcarbazole.

Specific examples of the compound represented by the above general formula (7) are 1,2-bis(4-diethylaminostyryl) benzene, and 1,2-bis(2,4-dimethoxystyryl)benzene.

Specific examples of the compound represented by the above general formula (8) are 3-styryl-9-ethylcarbazole, and 3-(4-methoxystyryl)-9-ethylcarbazole.

Specific examples of the compound represented by the above general formula (9) are 4-diphenylaminostilbene, 4-dibenzylaminostilbene, 4-ditolylaminostilbene, 1-(4-diphenylaminostyryl)naphthalene, and 1-(4-diethylaminostyryl)naphthalene.

Specific examples of the compound represented by the above general formula (10) are 4'-diphenylamino-α-phenylstilbene, and 4'-methylphenylamino-α-phenylstilbene.

Specific examples of the compound represented by the above general formula (11) are 1-phenyl-3-(4-diethylaminostyryl-5-(4-diethylaminophenyl)pyrazoline, and 1-phenyl-3-(4-dimethylaminostyryl)-5-(4-dimethylaminophenyl) pyrazoline.

As other positive hole transporting materials, there are, for example, oxadiazole compounds such as 2,5-bis(4-diethylaminophenyl)-1,3,4-oxadiazole, 2,5-bis[4-(4-diethylaminostyryl)phenyl]-1,3,4-oxadiazole, and 2-(9-ethylcarbazolyl-3-)-5-(4-diethylaminophenyl)-1,3,4-oxadiazole; and oxazole compounds such as 2-vinyl-4-(2-chlorophenyl)-5-(4-diethylaminophenyl)oxazole, and 2-(4-diethylaminophenyl)-4-phenyloxazole. In addition, besides the above low-molecular weight compounds, the following polymeric compounds such as poly-N-vinylcarbazole, halogenated poly-N-vinylcarbazole, polyvinyl pyrene, polyvinyl anthracene, pyrene-formaldehyde resin, and ethylcarbazole-formaldehyde resin can be employed.

As electron transporting materials, there are, for example, chloranil, bromanil, tetracyanoethylene, tetracyanoquinone dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b] thiophene-4-one, and 1,3,7-trinitrodibenzothiophene-5,5-dioxide. These electron transporting materials can be employed alone or in combination.

The liquid developer for use in the present invention will now be explained in detail.

The liquid developer for use in the present invention is prepared by dispersing toner particles which comprises a coloring agent and a resin in a carrier liquid comprising a silicone oil.

The silicone oil contained in the carrier liquid of the liquid developer for use in the present invention has a polysiloxane structure and never gives rise to any problem of causing a charge transporting material to ooze from a charge transport layer of an organic electrophotographic photoconductor when used in combination therewith. Furthermore, in the case where the silicone oil for use in the present invention is used as the carrier liquid for the liquid developer, no oxides which will cause an unpleasant odor are generated therefrom when it is brought into contact with a heat-application roller which is heated for image fixing. Accordingly, the liquid developer for use in the present invention does not cause any environmental pollution problems even when a large number of copies are made at high speed. The liquid developer comprising a carrier liquid which contains the above-mentioned silicone oil is regarded as advantageous from the viewpoint of hygiene.

The aforementioned silicone oil for use in the present invention has another advantage that evaporation loss is extremely small over the isoparaffin solvents.

As previously explained, the silicone oil is suitable for the carrier liquid of the liquid developer when it is used for image formation in combination with an organic electrophotographic photoconductor. The superiority of the silicone oil as the carrier liquid for the liquid developer can be demonstrated in particular when a large number of copies are made at high speed.

As the silicone oil, conventional dimethyl polysiloxane, for example, commercially available "SH200", made by Toray Silicone Co., Ltd.; and "KF96", made by Shin-Etsu Polymer Co., Ltd., can be used. However, (i) a phenylmethyl silicone oil obtained by substituting a phenyl group for at least one methyl group of the dimethyl polysiloxane oil and (ii) a cyclic dimethyl polysiloxane oil are more preferable as the carrier liquids for the liquid developer.

As the commercially available phenylmethyl silicone oil for use in the present invention, "SH510", "SH550" and "SH710", made by Toray Silicon Co., Ltd.; and "KF56" and "KF58", made by Shin-Etsu Polymer Co., Ltd., can be employed.

As the commercially available cyclic dimethyl polysiloxane oil for use in the present invention, "SH344" and "DC345", made by Toray Silicon Co., Ltd.; and "KF-994" and "KF-993", made by Shin-Etsu Polymer Co., Ltd., can be employed.

These silicone oils can be used alone or in combination. Alternatively, they may be used together with conventional isoparaffin solvents. In this case, it is preferable that the isoparaffin solvent be contained in the carrier liquid in an amount of 50 vol. % or less, and more preferably 30 vol. % or less.

Examples of commercially available isoparaffin solvents are "Isopar L" (boiling point of 188° to 210° C.), "Isopar M" (boiling point of 205° to 252° C.), "Isopar G" (boiling point of 158° to 177° C.) and "Isopar H" (boiling point of 174° to 190° C.), made by Exxon Chemical Japan Ltd.; "IP Solvent 2028" (boiling point of 210° to 265° C.), "IP Solvent 2835" (boiling point of 275° to 350° C.) and "IP Solvent 1620" (boiling point of 166° to 205° C.), made by Idemitsu Petrochemical Co., Ltd.; "Nisseki Isosol 400" (boiling point of 206° to 257° C.), made by Nippon Petrochemicals Co., Ltd.; and "Isododecane" (boiling point of 176° to 185° C.), made by BP Far East Ltd. In addition to the above, isooctane and ligroin, both having a boiling point ranging from 120° to 190° C. can be used.

In the present invention, conventional toner particles can be dispersed in a carrier liquid comprising a silicone oil.

As previously described, toner particles comprise a coloring agent and binder resin.

Examples of inorganic pigments used as the coloring agent include commercially available "Printex G", "Printex V", "Printex U", "Special Black 15" and "Special Black 4" (made by Degussa Japan Co., Ltd.); "#44", "#30", "MR-11" and "MA-100" (made by Mitsubishi Carbon Co.); "Mogul L", "Black Pearl 1300", "Black Pearl 1100", "Black Pearl 900", "Regal 400" and "Regal 660" (made by Cabot Co., Ltd.); and "Neospectra II", "Robin 1035" and "Robin 1252" (made by Columbia Carbon Ltd.).

Examples of organic pigments used as the coloring agent include Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Naphthol Red, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B, Indigo, Thioindigo, Oil Pink and Bordeaux 10B.

For the binder resin for use in toner particles, copolymers and graft copolymers of vinyl monomer A having the following formula (I) and vinyl monomer B selected from the group consisting of a vinyl monomer having formula (II), vinylpyrridine, vinylpyrrolidone, ethylene glycol dimethacrylate, styrene, divinylbenzene and vinyltoluene can be employed.

[Vinyl monomer A]

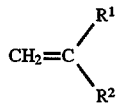

(I)

wherein $R^1$ represents hydrogen or a methyl group; and $R^2$ represents $—COOC_nH_{2n+1}$, in which n is an integer of 6 to 20.

[Vinyl monomer, one of vinyl monomer B]

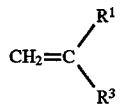

(II)

wherein $R^1$ represents hydrogen or a methyl group; and $R^3$ represents $—COOC_nH_{2n+1}$, in which n is an integer of 1 to 5,

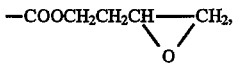

—COOH, —$COOCH_2CH_2OH$, —$COOCH_2CH_2N(CH_3)_2$, or —$COOCH_2CH_2N(C_2H_5)_2$.

In addition to the above, the following binder resins can be used in the present invention.

(a) Commercially available synthetic polyethylene, polypropyrene and modified products thereof:

"N-10" "N-11" "N-12" "N-14" "N-34" "N-45" "C-10" "C-13" "C-15" "C-16" "E-10" "E-11" "E-12" "E-14" and "E-15" made by Eastman Chemical Products, Inc.;

"110P" "220P" "220MP" "320MP" "410MP" "210MP" "10MP" "405MP" "200P" "4202E" and "4053E" made by Mitsui Petrochemical Industries, Ltd.;

"131P" "151P" "161P" "171P" "E300" and "E250P" made by Sanyo Chemical Industries, Ltd.;

"H1", "H2", "A1", "A2", "A3" and "A4", made by Sazol Co., Ltd.;

"OA Wax" and "A Wax", made by BASF Japan Ltd.;

"Bareco 500", "Bareco 2000", "E-730", "E-2018", "E-2020", "E-1040", "Petronaba C", "Petronaba C-36", "Petronaba C-400" and "Petronaba C-7500", made by Petrolite Co., Ltd.;

"PE580", "PE130", "PED121", "PED136", "PED153", "PED521", "PED522" and "PED534", made by Hoechst Japan Limited.;

"DYNI", "DYNF", "DYNH", "DYNJ" and "DYNK", made by Union Carbide Japan K.K.;

"Orlizon 805", "Orlizon 705" and "Orlizon 50", made by Monsanto Co.;

"Alathon 3", "Alathon 10", "Alathon 12", "Alathon 14", "Alathon 16", "Alathon 20", "Alathon 22" and "Alathon 23", made by Du pont de Nemours, E.I. & Co.;

"AC Polyethylene 6", "AC Polyethylene 6A" and "AC Polyethylene 15", made by Allied Chemical Corp.; and "Evaflex 150", "Evaflex 210", "Evaflex 220", "Evaflex 250", "Evaflex 260", "Evaflex 310", "Evaflex 360", "Evaflex 410", "Evaflex 420", "Evaflex 450", "Evaflex 460", "Evaflex 550" and "Evaflex 560", made by Du Pont-Mitsui Polychemicals Co., Ltd.

(b) Natural waxes such as carnauba wax, montan wax, candelilla wax, sugar cane wax, ouricury wax, beeswax, Japan wax and rice bran wax.

(c) Natural resins such as etser gum and hardened rosin.

(d) Natural-resin-modified cured resins such as natural resin modified maleic acid resin, natural resin modified phenolic resin, natural resin modified polyester resin, natural resin modified pentaerythritol resin and epoxy resin.

The liquid developer according to the present invention can be prepared by dispersing the above-mentioned coloring agent, binder resin and carrier liquid containing at least a phenylmethyl silicone oil or a cyclic dimethyl polysiloxane in a dispersion mixer such as a ball mill, Kitty mill, disk mill, pin mill and oscillating mill, and kneading the mixture to prepare a toner particle having a diameter of 0.1 to 4.0 μm.

In the preparation of the liquid developer for use in the present invention, the coloring agent may be preferably kneaded together with the binder resin such as the previously-mentioned synthetic polyethylenes, natural resins, and natural-resin-modified cured resins prior to the dispersion in the carrier liquid.

Other features of this invention will become apparent in the course of the following description of exemplary embodiments, which are given for illustration of the invention and are not intended to be limiting thereof.

Preparation of Electrophotographic Photoconductor No. 1

[Formation of Charge Generation Layer]

The following components were mixed to prepare a charge generation layer coating liquid:

| | Parts by Weight |
|---|---|
| Disazo pigment of following formula: | 8 |
| 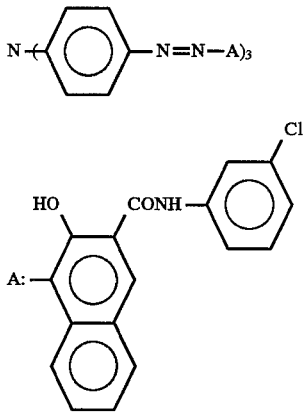 | |
| Methoxymethylated nylon ("Toredine F80" (Trademark) made by Teikoku Chemical Industry Co., Ltd. | 0.5 |
| Tetrahydrofurfuryl alcohol | 250 |

The thus prepared charge generation layer coating liquid was coated on an aluminum surface of an aluminum-deposited polyethylene terephthalate film serving as a support by a doctor blade and dried, so that a charge generation layer having a thickness of 0.2 μm was formed on the support.

[Formation of Charge Transport Layer]

The following components were mixed to prepare a charge transport layer coating liquid:

| | Parts by Weight |
|---|---|
| Charge transporting material of the following formula: | 90 |
| 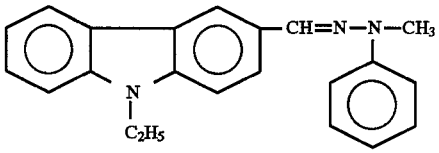 | |
| Polycarbonate "Panlite L-1250" made by Teijin Limited. | 100 |
| Tetrahydrofuran | 800 |

The thus obtained charge transport layer coating liquid was coated on the above-prepared charge generation layer by a doctor blade and dried, so that a charge transport layer having a thickness of 20 μm was formed on the charge generation layer. Thus, electrophotographic photoconductor No. 1 was prepared as shown in FIG. 3.

Preparation of Electrophotographic Photoconductor No. 2

[Formation of Charge Generation Layer]

The same charge generation layer coating liquid as employed in Electrophotographic Photoconductor No. 1 was coated on an aluminum surface of an aluminum-deposited polyethylene terephthalate film serving as a support by a doctor blade and dried, so that a charge generation layer having a thickness of 0.2 μm was formed on the support.

[Formation of Charge Transport Layer]

The following components were mixed to prepare a charge transport layer coating liquid:

| | Parts by Weight |
|---|---|
| Charge transporting material of the following formula: | 80 |

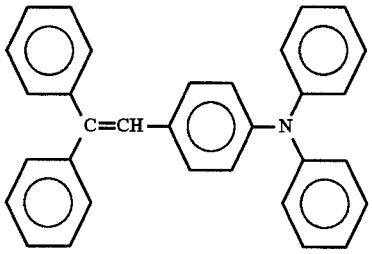

| | |
|---|---|
| Polycarbonate ("Lexan 141" (Trademark) made by Engineering Plastics, Ltd. | 100 |
| Tetrahydrofuran | 750 |

The thus obtained charge transport layer coating liquid was coated on the above-prepared charge generation layer by doctor blade and dried, so that a charge transport layer having a thickness of 20 μm was formed on the charge generation layer. Thus, electrophotographic photoconductor No. 2 was prepared as shown in FIG. 3.

Preparation of Electrophotographic Photoconductor No. 3

[Formation of Intermediate Layer]

The following components were mixed to prepare an intermediate layer coating liquid:

| | Parts by Weight |
|---|---|
| 25% aqueous solution of water-soluble polyvinyl butyral "S-Lec W-201" (Trademark), made by Sekisui Chemical Co., Ltd. | 50 |
| Water | 150 |
| Methanol | 200 |

The thus prepared intermediate layer coating liquid was coated on an aluminum sheet having a thickness of 0.2 mm by dip coating and dried, so that an intermediate layer having a thickness of 0.3 μm was formed on the support.

[Formation of Charge Generation Layer]

The following components were mixed to prepare a charge generation layer coating liquid:

| | Parts by Weight |
|---|---|
| Trisazo pigment of following formula: | 3 |

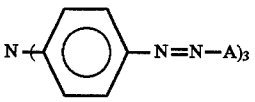

-continued

| | Parts by Weight |
|---|---|

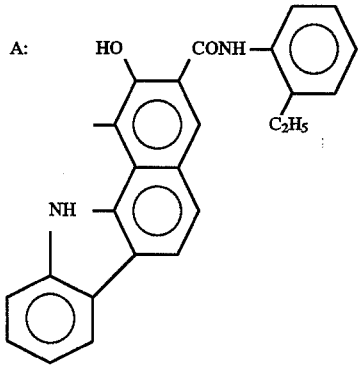

| | |
|---|---|
| Butoxymethylated polyamide made by Teikoku Chemical Industry Co., Ltd. | 1 |
| Polyester ("Vylon 200" (Trademark) made by Toyobo Co., Ltd.) | 0.5 |
| Dimethylformamide | 200 |
| Tetrahydrofuran | 50 |

The thus prepared charge generation layer coating liquid was coated on the above-prepared intermediate layer by dip coating and dried, so that a charge generation layer having a thickness of 0.2 μm was formed on the intermediate layer.

[Formation of Charge Transport Layer]

The following components were mixed to prepare a charge transport layer coating liquid:

| | Parts by Weight |
|---|---|
| Charge transporting material of the following formula: | 80 |

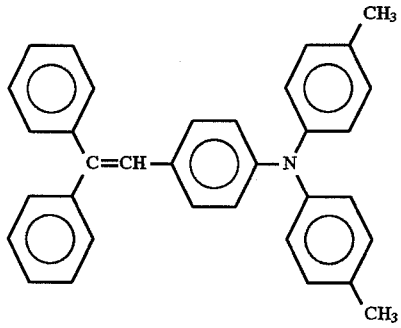

| | |
|---|---|
| Polycarbonate "Panlite K-1300" made by Teijin Limited. | 100 |
| Methylene chloride | 800 |

The thus obtained charge transport layer coating liquid was coated on the above-prepared charge generation layer by dip coating and dried, so that a charge transport layer having a thickness of 18 μm was formed on the charge generation layer. Thus, electrophotographic photoconductor No. 3 was prepared.

To evaluate the photoconductive characteristics of the thus obtained electrophotographic photoconductors No. 1 to No. 3, liquid developers were prepared.

[Preparation of Liquid Developer (A)]

The following components were placed in a small pot and dispersed for 40 hours.

| | Amount |
|---|---|
| Wax ("Sanwax 161-P" (Trademark) made by Sanyo Chemical Industries, Ltd.) | 5 g |
| Binder, 2-ethylhexyl-methacrylate-lauryl-methacrylate-methacrylic-acid (2-EHMA—LMA—MAA) (40:40:20) | 35 g |
| Carbon black "Raben 1035" (Trademark) made by Columbia Carbon Ltd. | 2 g |
| Auxiliary dye "Alkali Blue" | 2 g |
| Phenylmethyl silicone oil "KF-58" (Trademark), made by Shin-Etsu Polymer Co., Ltd. | 100 g |

After the completion of the dispersion over a period of 40 hours, the above mixture was further dispersed for 3 hours with the addition of 350 g of the commercially available phenylmethyl silicone oil "KF-58" (Trademark), made by Shin-Etsu Polymer Co., Ltd., so that a concentrated toner was obtained.

100 g of the above obtained concentrated toner was diluted with 1 l of the commercially available phenylmethyl silicone oil "KF-58", serving as a carrier liquid, whereby liquid developer (A) for use in the present invention was prepared.

[Preparation of Liquid Developer (B)]

The method of preparing liquid developer (A) was repeated except that the commercially available phenylmethyl silicone oil "KF-58", made by Shin-Etsu Polymer Co., Ltd, serving as a carrier liquid employed in liquid developer (A) was replaced by a commercially available isoparaffin solvent, "Isopar H" (Trademark), made by Exxon Chemical Japan Ltd., whereby liquid developer (B) for comparison with liquid developer (A) was prepared.

To evaluate the photoconductivity of the above-prepared electrophotographic photoconductors No. 1 to No. 3, each photoconductor was immersed in the above liquid developer (A) for 5 days and incorporated into a commercially available copying apparatus, "CT-5085" (Trademark), made by Ricoh Company, Ltd., in which the polarity of a high-voltage electric source for charging was changed to a negative polarity.

The surface potential (V) of each photoconductor was measured after the charging. In the same manner, the surface potential at the background area of each photoconductor was measured after exposure to a light image.

The results are given in Table 1.

TABLE 1

| Photoconductor No. | Surface Potential after Charging (V) | Surface Potential after Exposure (V) |
|---|---|---|
| 1 | −720 | −30 to −50 |
| 2 | −706 | −30 to −50 |
| 3 | −912 | −30 to −50 |

Using the comparative liquid developer (B), the photoconductivity of the above-prepared electrophotographic photoconductors No. 1 to No. 3 was evaluated in the same manner as in the above.

The results are given in Table 2.

TABLE 2

| Photoconductor No. | Surface Potential after Charging (V) | Surface Potential after Exposure (V) |
|---|---|---|
| 1 | −730 | −370 to −410 |
| 2 | −700 | −350 to −400 |
| 3 | −905 | −400 to −450 |

The electrophotographic photoconductor No. 1 was subjected to a copying test using liquid developer (A) and comparative liquid developer (B).

As a result, there were no abnormality in the produced images when liquid developer (A) comprising a phenylmethyl silicone oil serving as a carrier liquid was used. In contrast, when comparative liquid developer (B) was used, a portion of a transfer sheet, corresponding to the portion of the photoconductor immersed in comparative liquid developer (B) before the copying operation, was stained dark with liquid developer (B).

According to the present invention, the organic electrophotographic photoconductor, which has been considered to be unadaptable to the wet-type electrophotographic image formation method, is adaptable to the liquid developer comprising toner particles and the carrier liquid which contains a silicone oil. In addition, the liquid developer for use in the present invention does not generate any unpleasant odor because the evaporation of the carrier liquid is minimized at the image fixing step. By the wet-type electrophotographic image formation method according to the present invention, the organic electrophotographic photoconductor is applicable in particular when a large number of copies are made at high speed.

What is claimed is:

1. A wet-type image formation apparatus comprising:

(a) a latent electrostatic image formation means for forming, on a latent-electrostatic-image-bearable photoconductive member, a latent electrostatic image corresponding to an original image;

(b) a wet-type development means for developing said latent electrostatic image into a visible toner image with a liquid developer which comprises (i) a carrier liquid and (ii) toner particles comprising a coloring agent and a binder resin, which are dispersed in said carrier liquid, said development means including a quantity of said liquid developer;

(c) an image-transfer means for transferring said visible toner image from said photoconductive member to a transfer sheet; and (d) an image-fixing means for fixing said visible toner image to said transfer sheet, which comprises a heat-application roller, wherein said carrier liquid comprises a silicone oil and contains at least about 50 vol. % of said silicone oil, and said photoconductive member is an organic photoconductive member.

2. The wet-type image formation apparatus as claimed in claim 1, wherein said organic photoconductor is of a single layer type in which a charge generating material and a charge transporting material are contained.

3. The wet-type image formation apparatus as claimed in claim 1, wherein said photoconductive layer comprises (i) a charge generation layer comprising an organic charge generating material, and (ii) a charge transport layer comprising a binder resin a charge transporting material, said charge generation layer and said charge transporting layer being overlaid on said electroconductive support.

4. The wet-type image formation apparatus as claimed in claim 1, wherein said organic electrophotographic photoconductor is in the shape of an endless belt.

5. The wet-type image formation apparatus as claimed in claim 1, wherein said organic electrophotographic photoconductor is in the shape of a drum.

6. The wet-type image formation apparatus as claimed in claim 1, wherein said silicone oil is a phenylmethyl silicone oil.

7. The wet-type image formation apparatus as claimed in claim 1, wherein said silicone oil is a cyclic dimethylpolysiloxane oil.

8. The wet-type image formation apparatus as claimed in claim 1, wherein said carrier liquid further comprises an isoparaffin solvent in an amount of 50 vol. % or less.

9. A wet-type image formation apparatus comprising:

(a) a latent electrostatic image formation means for forming, on a latent-electrostatic-image-bearable photoconductive member, a latent electrostatic image corresponding to an original image;

(b) a wet-type development means for developing said latent electrostatic image into a visible toner image with a liquid developer which comprises (i) a carrier liquid and (ii) toner particles comprising a coloring agent and a binder resin, which are dispersed in said carrier liquid, said development means including a quantity of said liquid developer;

(c) an image-transfer means for transferring said visible toner image from said photoconductive member to a transfer sheet;

(d) an image-fixing means for fixing said visible toner image to said transfer sheet, which comprises a heat-application roller; and (e) means for cleaning the surface of said photoconductive member so as to remove a residual developer on said photoconductive member, wherein said carrier liquid comprises a silicone oil and contains at least about 50 vol. % of said silicone oil, and said photoconductive member is an organic photoconductive member.

10. The wet-type image formation apparatus as claimed in claim 9, wherein said organic photoconductor is of a single layer type in which a charge generating material and a charge transporting material are contained.

11. The wet-type image formation apparatus as claimed in claim 9, wherein said photoconductive layer comprises (i) a charge generation layer comprising a charge generating material, and (ii) a charge transport layer comprising a charge transporting material, said charge generation layer and said charge transporting layer being overlaid on said electroconductive support.

12. The wet-type image formation apparatus as claimed in claim 9, wherein said organic electrophotographic photoconductor is in the shape of an endless belt.

13. The wet-type image formation apparatus as claimed in claim 9, wherein said organic electrophotographic photoconductor is in the shape of a drum.

14. The wet-type image formation apparatus as claimed in claim 9, wherein said silicone oil is a phenylmethyl silicone oil.

15. The wet-type image formation apparatus as claimed in claim 9, wherein said silicone oil is a cyclic dimethylpolysiloxane oil.

16. The wet-type image formation apparatus as claimed in claim 9, wherein said carrier liquid further comprises an isoparaffin solvent in an amount of 50 vol. % or less.

17. The wet-type image formation apparatus as claimed in claim 3, wherein said binder resin is polycarbonate.

18. The wet-type image formation apparatus as claimed in claim 3, wherein said charge transporting material is a compound having formula (1).

19. The wet-type image formation apparatus as claimed in claim 3, wherein said charge transporting material is a compound having formula (2).

20. The wet-type image formation apparatus as claimed in claim 3, wherein said charge transporting material is a compound having formula (3).

21. The wet-type image formation apparatus as claimed in claim 3, wherein said charge transporting material is a compound having formula (4).

22. The wet-type image formation apparatus as claimed in claim 3, wherein said charge transporting material is a compound having formula (5).

23. The wet-type image formation apparatus as claimed in claim 3, wherein said charge transporting material is a compound having formula (6).

24. The wet-type image formation apparatus as claimed in claim 3, wherein said charge transporting material is a compound having formula (7).

25. The wet-type image formation apparatus as claimed in claim 3, wherein said charge transporting material is a compound having formula (8).

26. The wet-type image formation apparatus as claimed in claim 3, wherein said charge transporting material is a compound having formula (9).

27. The wet-type image formation apparatus as claimed in claim 3, wherein said charge transporting material is a compound having formula (10).

28. The wet-type image formation apparatus as claimed in claim 3, wherein said charge transporting material is a compound having formula (11).

29. A wet-type image formation apparatus comprising:

(a) a latent electrostatic image formation means for forming, on a latent-electrostatic-image-bearable photoconductive member, a latent electrostatic image corresponding to an original image;

(b) a wet-type development means for developing said latent electrostatic image into a visible toner image with a liquid developer which comprises (i) a carrier liquid and (ii) toner particles comprising a coloring agent and a binder resin, which are dispersed in said carrier liquid, said development means including a quantity of said liquid developer;

(c) an image-transfer means for transferring said visible toner image from said photoconductive member to a transfer sheet; and (d) an image-fixing means for fixing said visible toner image to said transfer sheet, which comprises a heat-application roller, wherein said carrier liquid comprises a silicone oil selected from the group consisting of phenylmethyl silicone oils and cyclic dimethylpolysiloxane oils and mixtures thereof, and said photoconductive member is an organic photoconductive member.

30. A wet-type image formation apparatus comprising:

(a) a latent electrostatic image formation means for forming, on a latent-electrostatic-image-bearable photoconductive member, a latent electrostatic image corresponding to an original image;

(b) a wet-type development means for developing said latent electrostatic image into a visible toner image with a liquid developer which comprises (i) a carrier liquid and (ii) toner particles comprising a coloring agent and a binder resin, which are dispersed in said carrier liquid, said development means including a quantity of said liquid developer;

(c) an image-transfer means for transferring said visible toner image from said photoconductive member to a transfer sheet;

(d) an image-fixing means for fixing said visible toner image to said transfer sheet, which comprises a heat-application roller; and (e) means for cleaning the surface of said photoconductive member so as to remove a residual developer on said photoconductive member, wherein said carrier liquid comprises a silicone oil selected from the group consisting of phenylmethyl silicone oils and cyclic dimethylpolysiloxane oils and mixtures thereof, and said photoconductive member is an organic photoconductive member.

* * * * *